United States Patent [19]

Unrug et al.

[11] Patent Number: 4,693,638

[45] Date of Patent: Sep. 15, 1987

[54] ROOF BOLT ASSEMBLY HAVING A SEALING PLUG FOR PREVENTING A DETERIORATION OF THE MINE ROOF

[76] Inventors: Konstanty F. Unrug, 2917 Waco Td., Lexington, Ky. 40503; Edward D. Thompson, 132 Calmes Blvd., Winchester, Ky. 40391; Samir K. Nandy, 3489 Lansdowne Dr. Apt. 38, Lexington, Ky. 40502

[21] Appl. No.: 854,504

[22] Filed: Apr. 22, 1986

[51] Int. Cl.[4] ..... E21D 21/00

[52] U.S. Cl. ..... 405/259; 285/110

[58] Field of Search ..... 405/259, 260, 261; 285/110

[56] References Cited

U.S. PATENT DOCUMENTS

| | | | |
|---|---|---|---|
| 2,829,502 | 5/1958 | Dempsey | 405/261 |
| 3,326,004 | 6/1967 | Williams | 405/260 |
| 3,430,449 | 3/1969 | Novotney et al. | 405/261 |
| 3,913,928 | 10/1975 | Yamaguchi | 285/110 |
| 4,140,428 | 2/1979 | McLain et al. | 405/261 |
| 4,293,138 | 10/1981 | Swantee | 285/110 |
| 4,410,296 | 10/1983 | Unrug | 405/259 |
| 4,498,817 | 2/1985 | Oulsnan | 405/260 |
| 4,501,515 | 2/1985 | Scott | 405/261 |

*Primary Examiner*—Richard J. Scanlan, Jr.
*Assistant Examiner*—Kristina Hall
*Attorney, Agent, or Firm*—Birch, Stewart, Kolasch & Birch

[57] ABSTRACT

A roof bolt assembly for a mine roof of the mechanical point anchor type is provided with a sealing plug to preclude the flow of mine air into the roof hole surrounding the bolt. In one embodiment, the sealing plug is frusto-conically shaped with an axial bore which surrounds the bolt rod. In another embodiment, the sealing plug is cylindrical with a first set of resilient rings on the external surface for engaging the roof hole sidewalls and with a second set of resilient rings in an axial bore for engaging the bolt rod. The sealing plug is installed in the entrance of the roof hole out of contact with components of the assembly tensioning mechanism.

3 Claims, 7 Drawing Figures

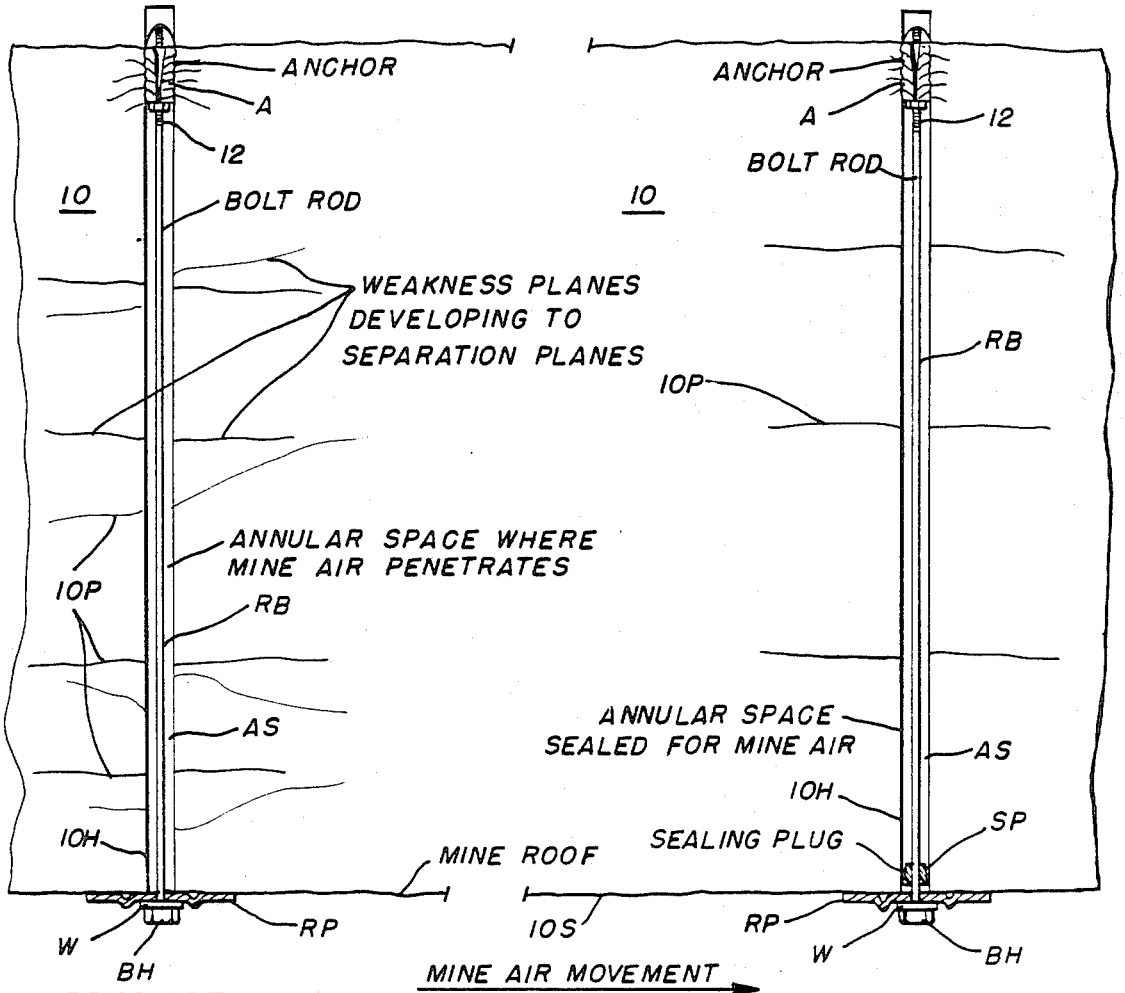
FIG. 1A
FIG. 1B
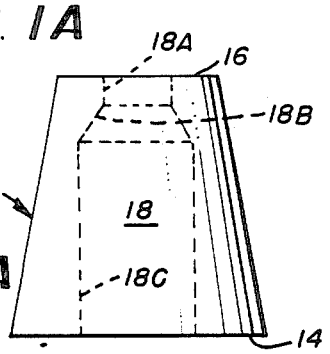
FIG. 2A
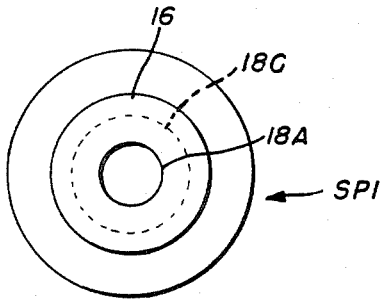
FIG. 2B
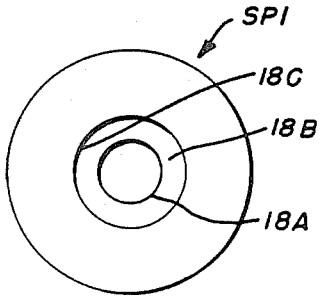
FIG. 2C

ROOF BOLT ASSEMBLY HAVING A SEALING PLUG FOR PREVENTING A DETERIORATION OF THE MINE ROOF

BACKGROUND OF THE INVENTION

This invention relates to a roof bolt assembly including mechanical point anchors, such as disclosed in U.S. Pat. No. 4,410,296 to Unrug, issued Oct. 18, 1983, for use underground, particularly in the roof of a coal mine.

In spite of the large technological advancements in mining and introduction of extensive safety regulations, roof falls are still the largest single cause of fatalities in coal mines. The statistics show, however, that less than one percent of roof falls are responsible for personal injury, but large numbers of falls occur in practically every mine. There is also a substantial cost involved in cleaning of the roof falls, reaching about twenty million dollars a year in Kentucky alone.

Roof conditions depend on the geological composition of the roof strata; strength of pillars and floor; and geometry of the mine opening. The geometry of openings can be influenced by design; however, only within certain limits imposed by the size of mining machinery and overall requirements of mining technology.

The geological composition of a roof is the major controlling factor of the roof stability. It depends on the rock creating an immediate roof at the opening. There is an established view that shaly roofs are potentially unstable, while sandstone roofs do not create problems.

The major factor influencing the rate of deterioration of the shaley mine roofs is a time-dependent weathering process. Shales are fine grain marine deposits with weakness planes perpendicular to the direction of the sedimentation. The tensile strength across those planes is much smaller than in a material without such planes. It has been found through extensive laboratory and field research that combinations of changes in temperature and humidity contribute to the shrinking and expansion of the shale material, as well as opening of the cracks along the weakness planes, where condensed moisture penetrates into the rock by diffusion and capilar pressure. Then the total area being influenced by moisture and its changes increases, as well as the total volume of affected rock. The deterioration process goes on and finally the roof begins to spoil, primarily between the bolts. Later, scalling shale falls from under the roof plates and the bolts lose their tension.

The above-described causes of deterioration take into account only roof surface as an exposed part of the rock. In reality, roof bolts are installed in holes drilled in the roof of a depth required by the roof plan for given conditions. As a consequence, the annular space between the bolt rod and roof rock becomes filled with mine air. Thus, the changes in humidity and temperature affect the side of the holes in the roof. These holes are normally drilled in a pattern three to four feet apart from each other. Those holes extend through the bedding and other weakness planes in the roof. Consequently, not only surface area of the visible roof is exposed to the influence of weathering, but also an invisible part of the roof rock in the vicinity of each hole.

A roof bolt with a mechanical bolt anchor—expansive shell such as disclosed in U.S. Pat. No. 4,410,296 to Unrug, works on the principle of an activated wedge, which is pulled downwards by rotation of the threaded end of the bolt rod which is threaded into the anchor. The wedge movement exerts a pressure on the expansive shells which press against the rock, sides of the roof holes. The shells have teeth-like protrusions to prevent slippage of the bolt anchor. The typical installation torque is 150 lb, which assures pretensioning of the roof bolt and compression of roof strata between the anchor and bolt plate against the roof surface.

From a rock mechanics standpoint, the pretensioning a stratified, shaley roof is essential, because it increases friction in a contact plane of strata and prevents separation. The mechanical principle of a bolted roof is a so-called "clamped beam effect" where strata are compressed and forced to work together. In this way, they are much stronger than when they deform one after one. The analogy exists between the mine roof and a car spring, where is order to have a comfortable ride in a car, provisions are made to allow particular leaf springs to slide on each other, thus assuring smooth bending of the whole package. The mine roof support is based on this same principle, but used for the opposite purpose, i.e., to increase stiffness by providing an additional friction between the roof members.

From the above explained principles of how a roof bolt works, it is clearly apparent that a decrease of bolt tension is detrimental for the mine roof. It can dramatically speed up the process of roof deterioration, and finally cause a roof fall.

In the contact area of the anchor shells against the rock hole sidewalls, large stresses exist, sometimes exceeding rock strength and thus producing fractures. Those fractures can also be affected by the moisture condensation and drying of rocks in the opposite cycle of the mine air seasonal changes. In other words, the destruction of the rock in the most strained part interacting with the shell can be accelerated, resulting in the bleeding of tension on a bolt.

Finally, the steel used for roof bolt is an inexpensive one which corrodes when exposed to moisture. It is well known that when humidity and temperature change, there is a condensation of moisture on metal objects in the mine. This can be seen when removing bolts from the mine roof. Rust at the rod does not greatly influence the performance of the bolt when superficial. But it is more critical on threads where fine dimensions and high stresses cause corrosion, which again contributes to the bleeding of tension.

The changes in mine atmosphere are caused by seasonal weather changes and cannot be controlled in a feasible way. During the winter cold air entering the mine (due to the mine ventilation) heats up by contact with the mine being warmer. So the air is able to absorb the moisture and it dries up the mine. During the summertime, the opposite process takes place. Warm and humid air enters the mine and cools off, thus causing condensation moisture, which is absorbed by the mine. Often visible drops of condensed water hang from the roof and especially metal parts of bolts.

Accordingly, a need in the art exists for a sealed roof bolt assembly to eliminate the exchange of air in the roof bolt holes by sealing entrances of the holes.

SUMMARY OF THE INVENTION

It is, therefore, an object of the present invention to provide an additional sealing element in a roof bolt assembly, which will eliminate the free flow of mine air into the holes containing the roof bolts.

A further object of the present invention is to eliminate, in an effective way, the exchange of moisture with the roof rock along the bolt holes.

Yet, another object of the present invention is to prevent penetration of moisture into the bedding planes of shale rock, as well as the opposite process of rock drying.

Still another object of the present invention is to prevent corrosion of the metal parts, particularly threaded ones of the roof bolt.

It is another object of the present invention to provide an inexpensive means of improvement in roof support which does not change the existing technology of roof bolt installation.

It is yet another object of the present invention to provide a substantial improvement in performance of mechanical anchor bolts over extended periods of time, by addition of a simple, sealing plug, which is inexpensive to manufacture and is at all times efficient, reliable and safe in operation.

The foregoing objects and others are accomplished in accordance with the present invention, generally speaking, by providing a uniquely-positioned, sealing element in the form of a suitably-shaped plug, in combination with a mechanical roof bolt of ordinary construction, such as disclosed in U.S. Pat. No. 4,410,296 to Unrug.

The plug, due to the nature of its material and construction, is forced into the entrance of the hole when the roof bolts are placed in the hole. At that time, the external surface of the plug is tightened against the hole walls, as well as against the bolt rod. Any suitable material may be used for the plug, such as rubber or plastic of a solid or foamy type.

The plug of the present invention in a first embodiment, comprises a frusto-conical shape with a circular cylindrical bore along the axis of symmetry. The bore has two step-like sections of different diameters. The larger diameter is at the base of the plug, while the smaller diameter of the bore is adjacent the upper part of the plug. The smaller bore diameter is slightly less than the diameter of the bolt rod to assure tightness. The larger bore at the base of the plug is larger than the bolt rod, to prevent increase of torque due to the friction between the rod and this part of the plug (where tight contact with the hole is developed) during the installation.

Another embodiment of the plug includes multiple (two to three) rings with elastic edges which serve the purpose of sealing the annular space between the rod and the hole. A similar inner ring seals the annular space between the rod and plug.

Two types of plugs can be made depending on the assembly arrangements. For roof bolts already assembled, the plug may be cut through one side, so it can be snapped onto the bolt without total disassembling of the anchor. The elastic material, such as rubber or plastic, will assure that the plug will return to the original shape and maintain the tightness of the plane where it is cut.

BRIEF DESCRIPTION OF THE DRAWINGS

The present invention will become more fully understood from the detailed description given hereinbelow and the accompanying drawings which are given by way of illustration only and are not intended to be limitative of the present invention. In the various illustrations where the elements are the same, similar numbers are retained.

FIGS. 1A and 1B are a cross-section of a typical mine roof in elevation, with FIG. 1A illustrating a prior art roof bolt assembly without the use of a sealing plug, and with FIG. 1B illustrating roof bolt assembly of the present invention, inclusive of the unique sealing plug of the present invention;

FIGS. 2A to 2C illustrate a first embodiment of a sealing plug for use with the roof bolt assembly of the present invention, FIG. 2A being a side elevational view, FIG. 2B being a top plan view of FIG. 2A, and FIG. 2C being a bottom plan view of FIG. 2A;

DESCRIPTION OF PREFERRED EMBODIMENTS

Figure 3A:
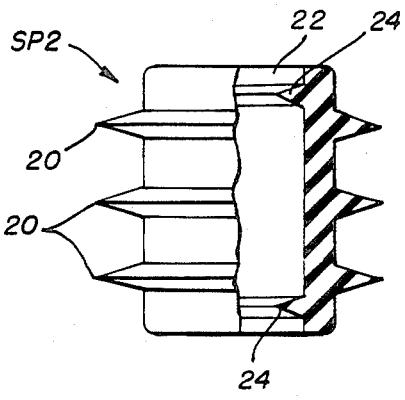
FIGS. 3A and 3B illustrates a second embodiment of a sealing plug for use with the roof bolt assembly of the present invention, FIG. 3A being a side elevational view partially in section, and FIG. 3B being a bottom plan view thereof.

Referring to FIG. 1, there is illustrated a typical installation of roof bolts in a mine roof. The roof bolt illustrated in FIG. 1A is a roof bolt, such as disclosed in U.S. Pat. No. 4,410,296 to Unrug, one of the present applicants. The disclosure of that patent is incorporated herein by reference to the extent that it might be necessary to understand the background of the present invention.

Referring to the roof bolt assembly in FIG. 1A, there is illustrated a cross-section of a mine roof generally designated 10, having a roof surface 10S and a roof bolt hole 10H drilled therein. Also illustrated are a series of weakness planes 10P which are the sedimentation planes that typically exist in a shale-type roof as a result of fine-grain marine deposits. The roof bolt assembly generlly includes an elongated roof bolt RB having distal ends. One of the distal ends is threaded, as at 12, into an anchor A, and the other distal end has a bolt head BH formed thereon. Sandwiched between bolt head BH and the surface of the mine roof 10S is a washer W which engages a roof plate RP. As fully described in the above-mentioned Unrug Patent, when the roof bolt is assembled and the bolt RB is rotated by means of the bolt head BH, the threads 12 screw into anchor A and anchor A expands so that the edges of the expansive shells become securely embedded in the sidewalls of the roof hole 10H. Consequently, the roof bolt becomes pretensioned.

However, as will be noted by reference to FIG. 1A, there is an annular space AS around the roof bolt RB which air can enter at the opening in the mine roof surface 10S. This air can have serious adverse effects, finally resulting in a roof fall, as fully described in the Background of Invention section hereinbefore.

Referring to FIG. 1A, there is illustrated a sealing plug SP of the present invention which is installed around the roof bolt RB within the roof hole 10H adjacent the opening, but totally out of contact with the roof plate RP, so that the presence of the sealing plug SP does not interfere in any way with the pre-tensioning of the roof bolt assembly.

FIGS. 2A to 2C illustrate a first embodiment of a sealing plug SP1 that may be utilized in the roof bolt assembly of the present invention installed in the location illustrated in FIG. 1B. This sealing plug SP1 with a frusto-conical shape has a base end 14 and a top end 16.

An axial bore 18 passes through plug SP1 and has stepped surfaces 18A, 18B, 18C of different diameters. The surface 18A adjacent the top end 16 of plug SP1 has a diameter slightly less than the diameter of an associated roof bolt RB, to which it is attached. Plug SP1 may be made of any suitable resilient material, such as rubber or plastic. The diameter of the base 14 of plugs SP1 is selected to be slightly larger than the diameter of the roof hole 10H, into which it becomes installed. Accordingly, the base 14 becomes force fit into an associated roof hole 10H to provide a hermetic seal.

Figure 3B:
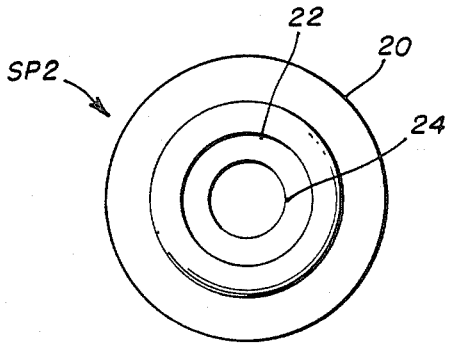

A second embodiment of a sealing plug suitable for use in the roof bolt assembly of the present invention is illustrated in FIGS. 3A and 3B. In this embodiment, the general shape of the sealing plug SP2 is cylindrical, and includes a plurality of external, resilient, spaced rings 20 formed on the exterior surface. The diameters of these external, resilient rings are selected to be slightly larger than the diameter of the associated roof bolt hole into which they are installed. The sealing plug SP2 of FIG. 3 also includes a central axial bore 22 extending therethrough which may include resilient rings 24, for operatively engaging the exterior surface of an associated roof bolt RB to which it becomes attached. The diameters of these resilient rings 24 are selected to be slightly smaller than the external diameter of an associated roof bolt RB.

Figure 4:
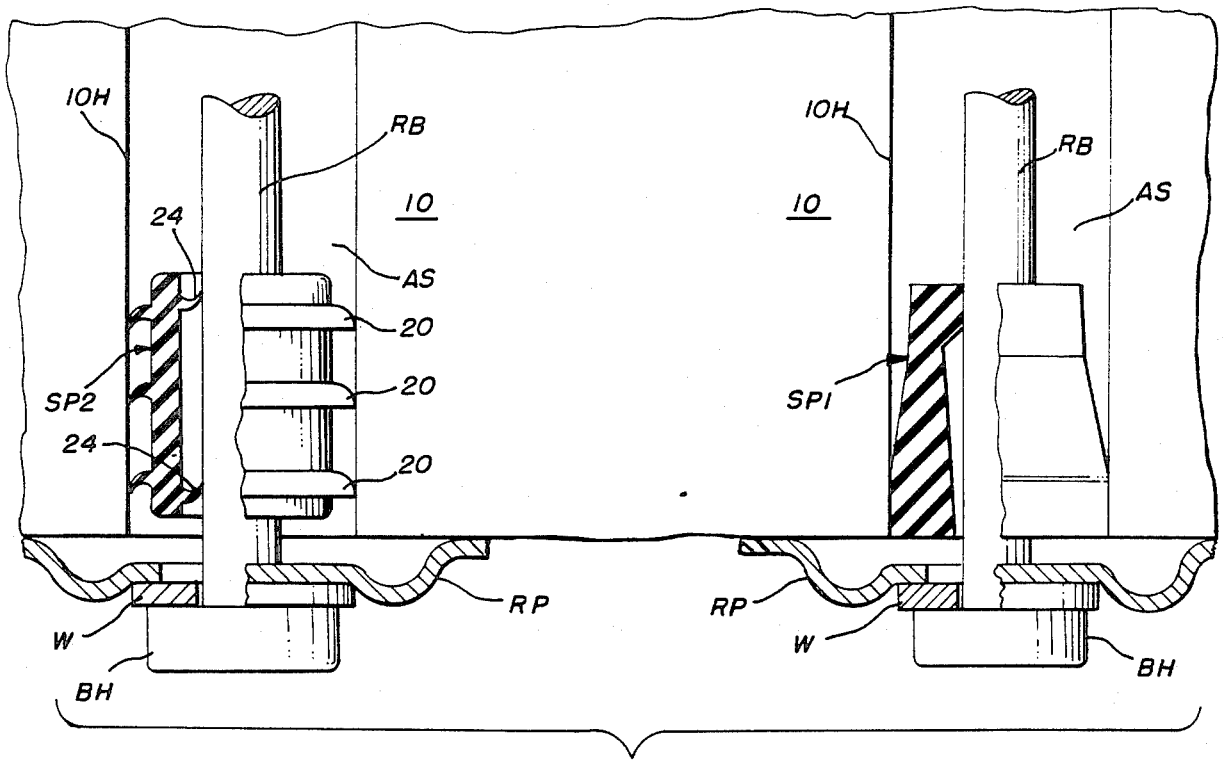
FIG. 4 is a cross-sectional view in elevation of a mine roof having the sealing plugs of FIGS. 2 and 3 installed therein.

FIG. 4 illustrates a typical mine roof installation according to the principles of the present invention wherein a sealing plug SP2 of the embodiment of FIGS. 3A and 3B is installed in the roof hole 10H on the left side of FIG. 4 and a sealing plug SP1 of the type illustrated in FIGS. 2A to 2C is installed within a roof hole 10H on the right side of FIG. 4. As clearly illustrated in both instances, the sealing plugs SP1, SP2 are totally contained within the associated roof holes 10H and spaced from any engagement or contact with roof plates RP. This is a significant discovery of the present invention that these sealing plugs must not interfere, in any way, with the pretensioning of the roof bolt assemblies since the resilient materials from which the sealing plugs SP are fabricated is likely to deteriorate or change in properties over extended periods of time. It has been found that if these sealing plugs were to be in operative engagement between the roof plates RP and roof surface 10S, that as the characteristics of the sealing plugs change (by yielding), the tension of the roof bolts will decrease causing separation of strata and will decrease, causing separation of strata, and perhaps even roof falls. These sealing plugs SP may be inserted onto the roof bolts RB before installation into a mine roof by placing them over the end of the roof bolt before the anchor A is installed thereon, so that the interior bores of the plugs engage the external surface of the bolts RB. In the alternative, the plugs SP may be provided with a split sidewall and installed over the bolt RB after the bolt has been installed in a mine roof by loosening the assembly to a sufficient degree to permit the sealing plugs SP to be snapped onto bolt RB. Because of the resilient nature of the materials from which the plugs are fabricated, this is a viable alternative, the resilience permitting the plug to seal against bolt RB and conform to the contours of roof hole 10H.

Other modifications may be made to the roof bolt assembly and the sealing plugs, as would occur to one of ordinary skill in the art, without departing from the spirit and scope of the present invention.

What is claimed is:

1. In a roof bolt assembly for preserving the natural geological structure of a mine roof including an elongated bolt rod with first and second distal ends, an expandable anchor threaded on the first end for operatively engaging the walls of a roof bolt hole bored in the mine roof at points inboard of the roof surface, a bolt head on the second end of the bolt rod, and a roof plate sandwiched between the roof surface and said bolt head, the entire assembly being pre-tensioned to tightly hold said roof plate against the roof surface, said hole bored in said roof being larger in diameter than the diameter of the roof bolt rod defining an annular space around the rod, the improvement comprising:

sealing means totally disposed within said annular space adjacent the second end of said bolt but spaced from said roof plate, said sealing means further being spaced from said roof surface such that a gap is formed between the roof surface and the sealing means, said sealing means precluding the entrance of air and moisture into said hole, said annular space around the rod being generally free from material in a region between the anchor and the sealing means such that said bolt is generally out of contact with the mine roof in this region.

2. The roof bolt assembly of claim 1 wherein said sealing means includes a resilient plug with a frusto-conically shaped exterior surface, a base end of the frusto-conical surface having a slightly larger diameter than said hole, a top end of the frusto-conical surface having a smaller diameter than said hole, and an axial bore extending through said plug for receiving the bolt rod, the axial bore in region adjacent the top end having a diameter slightly less than the diameter of the bolt rod and in region adjacent the base end of a diameter greater than the bolt rod.

3. The roof bolt assembly of claim 1 wherein said sealing means includes a cylindrical plug with at least one resilient ring on the external surface of the plug, the diameter of the plug in the region of the ring being slightly greater than the diameter of the hole, said cylindrical plug further including an axial bore for receiving the bolt rod and at least one resilient ring within said bore for sealingly engaging the bolt rod.

* * * * *